US005585903A

United States Patent [19]

Mammino et al.

[11] Patent Number: 5,585,903

[45] Date of Patent: Dec. 17, 1996

[54] FLUOROCARBON ELASTOMER SINGLE LAYER INTERMEDIATE TRANSFER MEMBER

[75] Inventors: Joseph Mammino, Penfield; Dennis A. Abramsohn, Pittsford; Donald S. Sypula, Penfield, all of N.Y.

[73] Assignee: Xerox Corporation, Stamford, Conn.

[21] Appl. No.: 558,538

[22] Filed: Oct. 7, 1994

[51] Int. Cl.[6] ..... G03G 15/16

[52] U.S. Cl. ..... 355/271; 355/274

[58] Field of Search ..... 355/275, 279, 355/214–271, 272–3; 430/126; 428/421–2, 244, 283; 174/255–7

[56] References Cited

U.S. PATENT DOCUMENTS

| | | | |
|---|---|---|---|
| 3,893,761 | 7/1975 | Buchan et al. . | |
| 4,403,848 | 9/1983 | Snelling . | |
| 4,430,412 | 2/1984 | Miwa et al. . | |
| 4,684,238 | 8/1987 | Till et al. . | |
| 4,708,460 | 11/1987 | Langdon . | |
| 4,796,048 | 1/1989 | Bean . | |
| 4,833,503 | 5/1989 | Snelling . | |
| 5,099,286 | 3/1992 | Nishise et al. . | |
| 5,119,140 | 6/1992 | Berkes et al. . | |
| 5,208,638 | 5/1993 | Bujese et al. | 355/274 |
| 5,233,396 | 8/1993 | Simms et al. . | |
| 5,237,374 | 8/1993 | Ueno et al. | 355/299 |
| 5,243,392 | 9/1993 | Berkes et al. | 355/275 |
| 5,298,956 | 3/1994 | Mammino et al. | 355/275 |
| 5,434,657 | 7/1995 | Berkes et al. | 355/273 |

*Primary Examiner*—Thu A. Dang
*Attorney, Agent, or Firm*—Oliff & Berridge

[57] ABSTRACT

A method and apparatus for producing a multi-image or multi-color image utilize an intermediate transfer member that is a single layer of fluorocarbon elastomer. The method produces high quality images that do not suffer from image or color shifting or degradation. The single layer intermediate transfer member can contain different zones of electrical properties within the single layer.

29 Claims, 3 Drawing Sheets

FLUOROCARBON ELASTOMER SINGLE LAYER INTERMEDIATE TRANSFER MEMBER

FIELD OF THE INVENTION

This invention relates to an apparatus and method for developing an image in which a toner image is transferred from an electrostatographic imaging member to an image receiving substrate via a single layer intermediate transfer member.

BACKGROUND

Typical electrostatographic printing machines (such as photocopiers, laser printers, facsimile machines, or the like) employ an imaging member that is exposed to an image to be printed. Exposure of the imaging member to the image to be printed or to a scanned image containing beam records an electrostatic latent image on the imaging member corresponding to the informational areas contained within the image to be printed. Generally, the electrostatic latent image is developed by bringing a toner or developer mixture into contact therewith.

One type of developer used in such printing machines is a liquid developer comprising a liquid carrier having toner particles disposed therein. Generally, a suitable colorant such as a dye or pigment, a charge director and a suitable binder are present in the toner particles. The liquid developer is brought into contact with the electrostatic latent image and the colored toner particles are deposited thereon in image configuration.

Developed toner images recorded on the imaging member may be transferred to an image receiving substrate such as paper or clear plastic via an intermediate transfer member. Transfer of the toner particles from the imaging member to the intermediate transfer member is conventionally accomplished electrostatically by means of an electrical potential between the imaging member and the intermediate transfer member. After the toner image has been transferred to the intermediate transfer member, it is then transferred in image configuration to the image receiving substrate, such as by contacting the substrate with the image on the intermediate transfer member under heat and/or pressure.

The use of an intermediate transfer member enables high throughput at modest process speeds. In color systems, the intermediate transfer member also improves registration of the final color toner image. Intermediate transfer members also allow for transfer of toner images to a broader range of substrates, including paper, plastics, etc. A disadvantage of using an intermediate transfer member is that a plurality of transfer steps is required. In the process of electrostatically transferring toner images from the imaging member to an intermediate transfer member, charge exchange can occur between toner particles and the transfer member, leading to less than complete toner transfer and poor image quality.

Intermediate transfer members employed in imaging apparatuses should exhibit substantially 100% transfer of toner particles from the imaging member to the intermediate transfer member and substantially 100% transfer of toner particles from the intermediate transfer member to the image receiving substrate. Substantially 100% toner transfer occurs when most or all of the toner material comprising the image is transferred and little or no residual toner remains on the surface from which the image was transferred. Substantially 100% toner transfer is particularly important when the imaging process involves generating full color images, since undesirable color shifting or degradation in the final colors obtained can occur when the primary color images are not efficiently transferred from the intermediate transfer member to the image receiving substrate.

Imaging processes wherein a developed image is first transferred to an intermediate transfer member and subsequently transferred from the intermediate transfer member to an image receiving substrate are known.

U.S. Pat. No. 4,796,048 (Bean) discloses an apparatus which transfers a plurality of toner images from a photoconductive member to a copy sheet. A single photoconductive member is used. The apparatus may include an intermediate transfer belt to transfer a toner image to a copy sheet with the use of a biased transfer roller. The intermediate transfer belt has a smooth surface, is non-absorbent and has a low surface energy.

U.S. Pat. No. 4,708,460 (Langdon) discloses an intermediate transport belt that is preferably made from a somewhat electrically conductive silicone material having an electrical conductivity of $10^9$ ohm-cm so that the belt is semiconductive. The apparatus includes a single photoconductive drum.

U.S. Pat. No. 4,430,412 (Miwa et al.) discloses an intermediate transfer member, which may be a belt-type member that is pressed onto an outer periphery of a toner image retainer with a pressure roller. The intermediate transfer member is formed with a laminate of a transfer layer comprising a heat resistant elastic body such as silicone rubber or fluororubber, and a heat resistant base material such as stainless steel. Silicone rubber is the only material shown in the examples as the transfer layer. A single layer fluorocarbon elastomer is not disclosed or suggested for the transfer member.

U.S. Pat. No. 3,893,761 (Buchan et al.) discloses a xerographic heat and pressure transfer and fusing apparatus having an intermediate transfer member which has a smooth surface, a surface free energy below 40 dynes per centimeter and a hardness from 3 to 70 durometer (Shore A). The transfer member, preferably in the form of a belt, can be formed, for example, from a polyamide film substrate coated with 0.1–10 millimeters of silicone rubber or fluoroelastomer. Silicone rubber is the only material shown in the example as the transfer layer. A single layer fluorocarbon elastomer is not disclosed or suggested.

U.S. Pat. No. 5,099,286 (Nishishe et al.) discloses an intermediate transfer belt comprising electrically conductive urethane rubber reportedly having a volume resistivity of $10^3$ to $10^4$ ohm-cm and a dielectric layer of polytetrafluoroethylene reportedly having a volume resistivity equal to or greater than $10^{14}$ ohm-cm.

U.S. Pat. No. 5,208,638 (Bujese et al.) relates to an intermediate transfer member comprising a fluoropolymer with a conductive material dispersed therein as a surface layer upon a metal layer, which in turn is upon a dielectric layer. The use of fluorocarbon elastomers is disclosed along with numerous other fluoropolymer materials, but there is no disclosure or suggestion of the improved efficiency achievable by the use of fluorocarbon elastomer, particularly without a substrate.

U.S. Pat. No. 5,233,396 (Simms et al.) discloses an apparatus having a single imaging member and an intermediate transfer member which is semiconductive and comprises a thermally and electrically conductive substrate coated with a semiconductive, low surface energy elastomeric outer layer that is preferably Viton® B-50 (a fluorocarbon elastomer comprising a copolymer of vinylidene fluoride and hexafluoropropylene).

U.S. Pat. Nos. 4,684,238 (Till et al.) and 4,690,539 (Radulski et al.) disclose intermediate transfer belts composed of polyethylene terephthalate or other suitable propylene materials. A single photoconductive drum is disclosed.

U.S. Pat. No. 5,119,140 (Berkes et al.) discloses a single layer intermediate transfer belt preferably fabricated from clear, carbon loaded or pigmented Tedlar® (a polyvinylfluoride available from E.I. du Pont de Nemours & Co.). Tedlar® suffers from poor conformability. The apparatus utilizes four individual image forming devices.

U.S. Pat. No. 5,298,956 (Mammino et al.) discloses a seamless intermediate transfer member comprising a reinforcing belt member coated or impregnated with a filler material of film forming polymer that can include fluorocarbon polymers. An intermediate transfer belt without reinforcement is not disclosed.

Conventional printing apparatuses in the art have used a single imaging station such as a photoreceptor drum or dielectric charge receiver. In such multi-image systems, each image is formed on the imaging member at an image forming station and then each image is developed at a developing station and transferred to an intermediate transfer member. Each of the images may be formed and developed on the imaging member sequentially and then the multi-image developed on the imaging member finally transferred to the intermediate transfer member, or, in an alternative method, each image may be formed on the imaging member, developed, and transferred to the intermediate transfer member, whereupon the imaging member will be cleaned before receiving the next image which, following development, is transferred in registration onto the prior image on the intermediate transfer member.

The multi-image system could be a color copying system or printing system in which each color of an image being copied is formed on the imaging member. Cyan, yellow, magenta and black are four toner colors commonly used in such color copying systems. As in the multi-image system above, each of the colored images may be formed and developed on the imaging member sequentially and then transferred to the intermediate transfer member, or, in the alternative, each color of an image may be formed on the imaging member, developed, and transferred to the intermediate transfer member in registration.

U.S. Pat. Nos. 4,403,848 and 4,833,503 (both to Snelling) disclose a printing system utilizing a single photoreceptor to produce a multi-color image. In such systems, the photoreceptor imaging member is charged and each color exposed and developed at spaced intervals on the photoreceptor. The photoreceptor is recharged following development of the preceding color but prior to exposure of the succeeding color. Buffers control the timing of the individual color images to assure registration of the color images with one another. Neither Snelling patent discloses the use of an intermediate transfer member, instead transferring the multicolor image directly from the imaging station to the substrate.

The conventional methods described above using a single imaging station generally require that the intermediate transfer member have rigidity in order to maintain registration of the image upon the intermediate transfer member during transfer from the imaging member. Thus, a substrate or other reinforcing member has been used to provide the needed rigidity. Transfer of an image from the imaging member to the intermediate transfer member is usually effected by electrostatic means, so that the substrate should be electrically semiconductive. Transfer of the image from the intermediate transfer member to an image receiving substrate is often accomplished with the aid of heat and pressure, so that the substrate should also be thermally conductive. Examples of conventional substrate materials include polyesters, polyimides, stainless steel and numerous metallic alloys.

SUMMARY OF THE INVENTION

The present invention relates to a single layer fluorocarbon elastomer intermediate transfer member for use in electrostatographic print machines. The single layer fluorocarbon elastomer possesses the requisite strength, electrical semiconductivity and conformability to an image receiving substrate for an intermediate transfer member. The single layer intermediate transfer member is also able to achieve substantially 100% toner transfer to an image receiving substrate in a process in which images are produced utilizing a plurality of imaging stations.

Another embodiment of the present invention relates to the use of a single layer fluorocarbon elastomer intermediate transfer member in an apparatus having a single imaging station, including systems in which each color is transferred to the intermediate transfer member prior to exposing and developing succeeding colors of the image and systems in which each color is exposed and developed on the imaging member on top of preceding developed color images on the imaging member.

The present invention also relates to an apparatus for transferring a toner image from a plurality of (i.e., at least two) imaging stations to an image receiving substrate employing a single layer fluorocarbon elastomer intermediate transfer member.

DETAILED DESCRIPTION OF PREFERRED EMBODIMENTS

Figure 1:
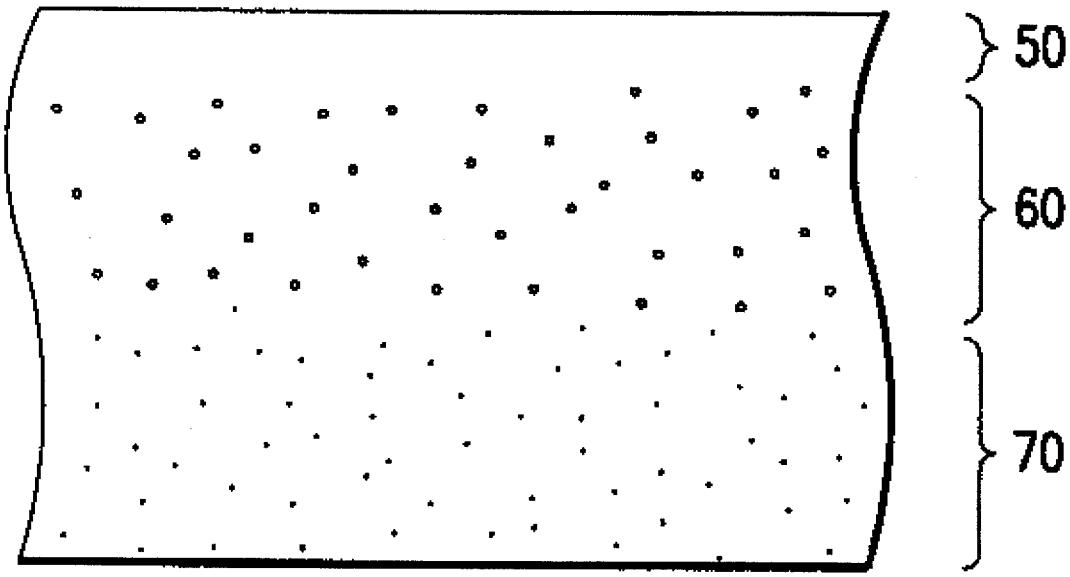
FIG. 1 is a schematic illustration of a single layer intermediate transfer member having different zones within the single layer.

The need remains in the art for an intermediate transfer member that can be used as a single layer without any substrate and that can achieve substantially 100% toner transfer and produce high quality images free of image shifting, color shifting and color degradation in a process in which multi-images or color images are produced.

In one embodiment, a printing apparatus and method of the present invention utilize a plurality of imaging stations. It has been found that in such an apparatus, an intermediate transfer member does not require rigidity in order to maintain registration and prevent image shifting, color shifting or color degradation of the multi-image upon the intermediate transfer member. However, if a conductive backing or substrate is to be eliminated, the intermediate transfer member surface material must itself provide all of the requisite properties for an intermediate transfer member. That is, if the intermediate transfer member is to be a single layer, the intermediate transfer member material must itself possess excellent strength, thermal conductivity and electrical semiconductivity, since a substrate that would otherwise add strength and conductivity properties would be absent. In addition, the intermediate transfer member material also needs to be resistant to attack from toner or developer materials as well as be able to withstand exposure to the electrical, mechanical and thermal environment of a printing apparatus.

In a second embodiment, a single layer intermediate transfer member is used in systems having only a single imaging station. In a single imaging station system in which one color is used or each color of a multi-color image is developed and transferred sequentially to the intermediate transfer member, a single layer intermediate transfer member can be used when rigidity is unnecessary for successful image transfer. Single layer intermediate transfer members are preferably utilized in such systems when rougher image receiving substrates are used. A rigid material, such as the imaging member or a reinforced or substrate backed intermediate transfer member, can lack the conformability necessary to achieve a full and complete image on the rough image receiving material. Known reinforcements of intermediate transfer members include metal or synthetic sheets and organic or inorganic fibrous matts. A nonreinforced single layer intermediate transfer member can eliminate the conformability problem and thus enlarge the class of image receiving substrates usable in such systems.

Another system utilizing a single imaging station is one in which each color of a multi-color image is sequentially formed and developed in registration on top of previously formed and developed colors of the image on the imaging member. The entire multi-color image is then transferred to the intermediate transfer member. A single layer intermediate transfer member can be used in this system because, as with the multiple imaging station system above, the intermediate transfer member does not require rigidity.

By "single layer fluorocarbon elastomer" is meant that the intermediate transfer member layer is not backed by a substrate conventional to the art or reinforced with a reinforcing sheet or woven or nonwoven fibrous matt, including endlessly configured reinforcement. It is also intended that "single layer fluorocarbon elastomer" encompass intermediate transfer members having two or more different zones within the layer. For example, one zone of a fluorocarbon elastomer intermediate transfer member may contain conductive filler while a second zone of fluorocarbon elastomer contains a different filler or a different amount of filler, including no filler. In the above example, the intermediate transfer member remains a single layer because the formation method, such as spin casting or extrusion, causes sufficient interaction of the binder in each zone to prevent formation of distinctive laminates.

It has been discovered by the inventors that fluorocarbon elastomers possess the ability to act as single layer intermediate transfer members. Preferably, the fluorocarbon elastomer is a fluorocarbon elastomer such as that sold under the tradename Viton®, available from E.I. du Pont de Nemours & Co. Suitable fluorocarbon elastomers include copolymers and terpolymers of vinylidene fluoride, hexafluoropropylene, tetrafluoroethylene, chlorotrifluoroethylene and propylene, including vinylidene fluoride/hexafluoropropylene copolymers and vinylidene fluoride/hexafluoropropylene/tetrafluoroethylene terpolymers (such as those sold by E.I. du Pont de Nemours & Co. as Viton GF, Viton GFLT, Viton E-600C, Viton B-50, and other specialty materials available from du Pont including Viton VTR-5927, Viton 7000, Viton VTX 7055, Viton VTX 7056 and Viton VTX 7048). Most preferably, the single layer intermediate transfer member is comprised of an elastomeric copolymer of vinylidene fluoride and hexafluoropropylene. Other suitable fluoroelastomeric copolymers can also be used.

The single layer intermediate transfer member preferably has a thickness of 1 to 25 mils, more preferably 3 to 15 mils. The intermediate transfer member is preferably seamless (i.e., an endless belt). The intermediate transfer member can be formed by any process conventionally known in the art such as extrusion or spin casting. The single layer intermediate transfer member preferably has a Shore A durometer hardness of 50–85.

FIG. 1 illustrates one example of a single layer intermediate transfer member layer having different zones. The zones are differentiated by having different electrical properties, such as conductivity and resistivity. A single fluorocarbon elastomer is used as the binder throughout the layer. In FIG. 1, top zone 50 is insulating in containing no filler material. Middle zone 60 contains a filler that renders the middle zone resistive. Bottom zone 70 contains a conductive filler such as carbon black that renders the bottom zone conductive.

In general, the top zone of a multiple zone single layer should have a thickness of less than or equal to 1 mil and a durometer hardness of 50 to 85 Shore A. If one or more middle zones are present, each such middle zone should have a thickness of 2 to 23 mils. A bottom zone should have a thickness of 1 to 22 mils. The durometer hardness of middle and bottom zones may be greater than 90 Shore A.

The filler materials can be any suitable filler materials known in the art to effect electrical property regulation of the single layer intermediate transfer member. U.S. Pat. No. 5,298,956, the entire disclosure of which is incorporated herein by reference, discloses suitable electrical property regulating materials that can be added to the single layer intermediate transfer member of this invention. Fillers include, but are not limited to, pigments, quaternary ammonium salts, dyes, conductive polymers or inorganic particles and the like. These fillers may be added in amounts ranging from about 1% by weight to about 50% by weight of the total weight of the member. Preferably, the fillers are added in amounts ranging from about 5% to about 35% by weight of the total weight of the member. The amount of filler added will depend on whether the particles are, for example, spherical, round, irregular, spheroidal, spongy, angular or in the form of flakes or leaves. Particles having a high aspect ratio do not require as high a loading as particles having a relatively lower aspect ratio. Particles which have relatively high aspect ratios include flakes and leaves. Particles which have a relatively lower aspect ratio are spherical and round particles.

A preferred conductive filler is carbon black. Carbon black can also be used to improve the tensile modulus and hardness of the single layer intermediate transfer member.

Other filler materials include pigments such as phthalocyanine pigments, such as metal free phthalocyanine, metal phthalocyanine such as vanadyl phthalocyanine and other phthalocyanines known in the art. Tetrathiafulvalene containing compounds such as tetrathiafulvalene tetracarbonic acid tetraethylester, octamethylthio-dibenzotetrathiafulvalene, octabenzylthio-dibenzo-tetrathiafulvalene, 4,4'-diphenyl-tetrathiafulvalene, tetrathiafulvalene, tetrathiafulvalene tetracarbonic acid and the like can be employed. Other pigment fillers include, but are not limited to, zinc oxide, tin oxide, titanium dioxide, amorphous selenium, trigonal selenium, selenium alloys and the like. Additional fillers can include tetracyanoquinodimethane (TCNQ) and other TCNQ complexes. Dyes such as dibromoanthanthrone, squarylium and quinacridones may also be used as fillers, as can suitable quaternary ammonium salts. Suitable conductive polymers that can be used as fillers include polyaniline, polyacetylene, polypyrrole and the like. Mixtures of any of the foregoing fillers can also be used.

A single layer intermediate transfer layer preferably has a conductivity less than or equal to $10^6$ ohm-cm. The resistivity of the intermediate transfer layer is preferably between $10^7$ to $10^{12}$ ohm-cm, inclusive.

Figure 2:
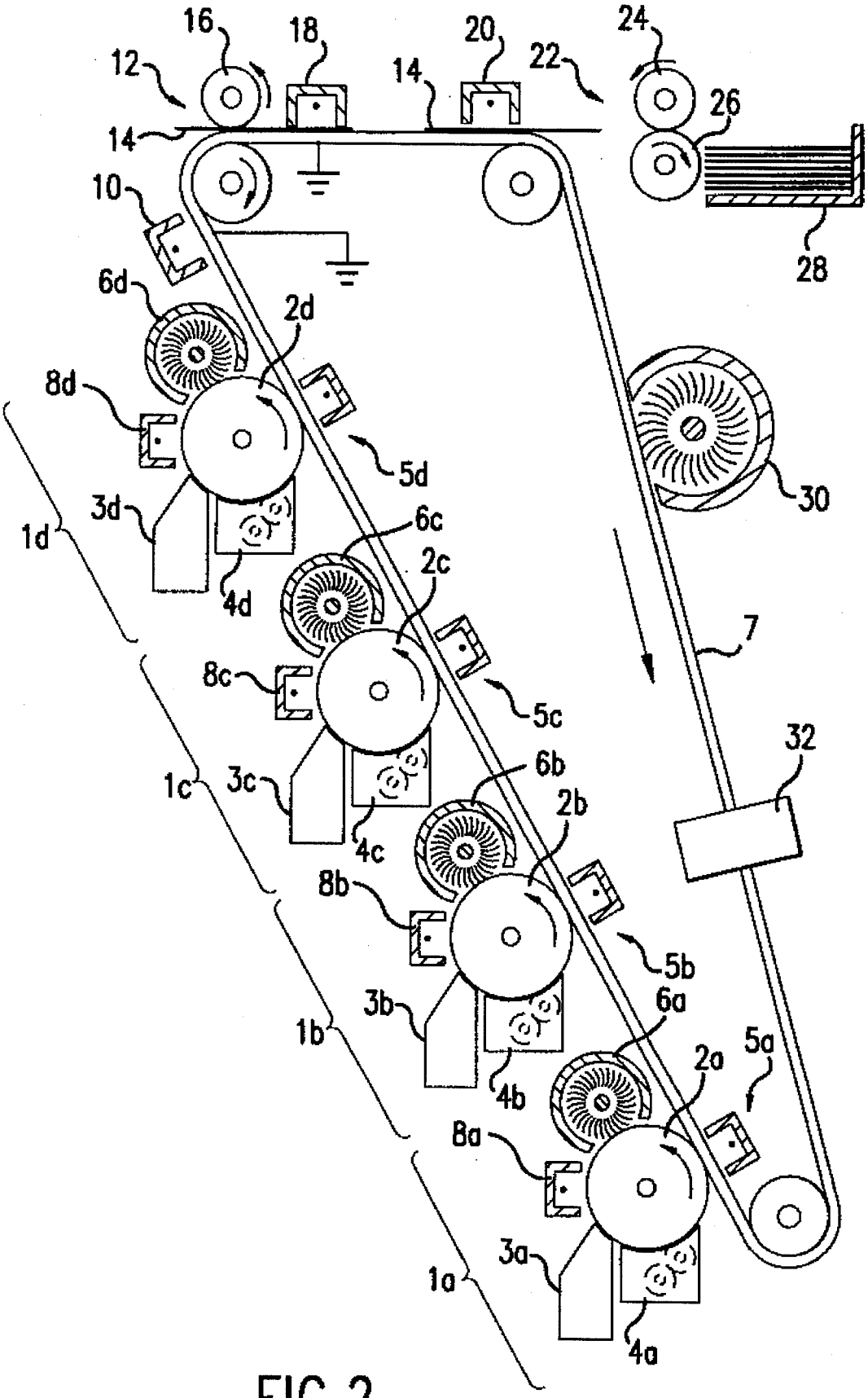
FIG. 2 is a schematic illustration of a multiple imaging station printing apparatus using a single layer intermediate transfer member.

An apparatus according to an embodiment of the invention will be described with reference to FIG. 2. In the multi-image or color printing apparatus illustrated, four imaging stations 1*a*, 1*b*, 1*c* and 1*d* are utilized. However, fewer imaging stations, but at least two, can be utilized. The imaging stations each comprise an image receiving member. In FIG. 2, the image receiving member is exemplified by a photoreceptor drum 2*a*, 2*b*, 2*c* or 2*d*. However, other appropriate image receiving members may include other electrostatographic imaging receptors, such as ionographic belts and drums, electrophotographic belts, etc. The image receiving members are supported for rotation in the direction of the arrows as shown. The imaging stations further comprise exposure structures 3*a*, 3*b*, 3*c* and 3*d*, developing structures 4*a*, 4*b*, 4*c* and 4*d*, transfer structures 5*a*, 5*b*, 5*c*, and 5*d*, cleaning structures 6*a*, 6*b*, 6*c* and 6*d* and charging structures 8*a*, 8*b*, 8*c* and 8*d*.

The single layer intermediate transfer member 7 is shown in the form of an endless belt supported for movement in an endless path such that incremental portions of the belt move past the imaging stations 1*a*, 1*b*, 1*c* and 1*d* for transfer of an image from each of the image receiving members 2*a*, 2*b*, 2*c* and 2*d*. Each imaging station 1*a*–1*d* is positioned adjacent intermediate transfer member belt 7 for enabling transfer of different images or color toner images to the intermediate transfer member in superimposed registration with one another.

For explanation of the printing process, a color copying system will be described. The intermediate transfer member 7 moves in a clockwise direction as illustrated by the arrow such that each incremental portion of the intermediate transfer member first moves past the imaging station 1*a*. A first image component, such as yellow, corresponding to the yellow component of an original is formed on the photoreceptor drum 2*a* using conventional electrophotographic components such as the charging structure 8*a*, the exposure structure 3*a* and the developing structure 4*a*. The developing structure develops a yellow toner image on the photoreceptor drum 2*a*. The drum rotates in a counterclockwise direction and contacts the intermediate transfer member as shown. The transfer structure 5*a*, which may, for example, comprise a corona discharge device or a biased transfer roller, serves to effect transfer of the yellow toner image to the intermediate transfer member at the area of contact between the photoreceptor drum and the intermediate transfer member.

The intermediate transfer member moves to imaging station 1*b*, where, for example, a magenta image component corresponding to the magenta component of the original image is formed on photoreceptor drum 2*b*. Following development of the magenta toner image, photoreceptor drum 2*b* rotates in a counterclockwise direction. The magenta image is transferred in superimposed registration with the yellow image previously transferred to the intermediate transfer member.

The cyan and black image components corresponding respectively to the cyan and black components of the original are formed, for example, on the photoreceptor drums 2*c* and 2*d*, respectively. These images are sequentially transferred to the intermediate transfer member 7 in a superimposed relationship resulting in a final composite toner image on the intermediate transfer member that comprises the four component colors.

In the above described printing process, the images are preferably developed using a liquid developer, although dry toner may also be used. Liquid developers comprise toner particles disposed within a liquid carrier. The toner particles generally comprise a suitable resin binder, such as polyethylene methacrylic acid or styrenebutadiene and a suitable colorant in the form of a dye or pigment. The liquid carrier may comprise, for example, a solvent such as Isopar® (branched aliphatic hydrocarbons available from Exxon Chemical Corporation) or Norpar® (high purity normal paraffinic liquids available from Exxon Chemical Corporation). The liquid developer and toner particles can also include known adjuvants such as charge directors, surfactants for improved solubility and plasticizers.

Following transfer of the images to the intermediate transfer member, the intermediate transfer member 7 is advanced to transfer station 12, where the composite multi-image or color image is transferred to an image receiving substrate 14 such as paper or plastic. The toner image may be transferred to the image receiving substrate by the use of heat and/or pressure. Electrostatic means may also be used to transfer the image to the substrate. The transfer preferably occurs at a temperature of 225°–400° F.

To produce a high quality image upon the image receiving substrate, it is necessary that the intermediate transfer member material be conformable to the image receiving substrate. Fluorocarbon elastomers possess the requisite conformability, unlike non-elastomeric prior art materials such as polyvinylfluoride. Polytetrafluoroethylene, for example Teflon®, also does not possess the requisite conformability to an image receiving substrate to produce a high quality image. By "conformable" is meant that the material is able to contact an image receiving substrate with substantially complete smoothness, that is, that the material conforms to match the topography or contour of the surface of the substrate. The image produced on the substrate is complete and full in color as a result. A material lacking the requisite conformability (i.e., that is not "conformable" as that term is defined herein) produces images having varying shades (i.e., areas lighter or darker in color and tone than other areas of the image that started at the same color and tone level) and even incomplete in areas where the toner is unable to contact the substrate.

At the transfer station, the developed toner image is transferred and fixed to the image receiving substrate 14. Following fixing of the image to an image receiving substrate, the image receiving substrate with the image permanently affixed thereto is advanced to catch tray 28.

Following transfer to an image receiving substrate, the intermediate transfer member 7 is advanced and prepared for receipt of the next multi-image or color image. Cleaning apparatus 30, comprising a conventional magnetic brush roll structure or soft bristle structure, removes residual toner particles remaining on the intermediate transfer member.

For systems employing only a single imaging station, the developed image can comprise a single color or multiple colors. Multi-color images are produced from a single imaging station by forming and developing each of the color images on the imaging member sequentially and then transferring the multi-color image to the intermediate transfer member, or, in the alternative, each color of the image may be formed on the imaging member, developed, and transferred to the intermediate transfer member in registration. Once the developed image is transferred to the intermediate transfer member, the remainder of the process is identical to that described above for multiple imaging station systems.

Figure 3:
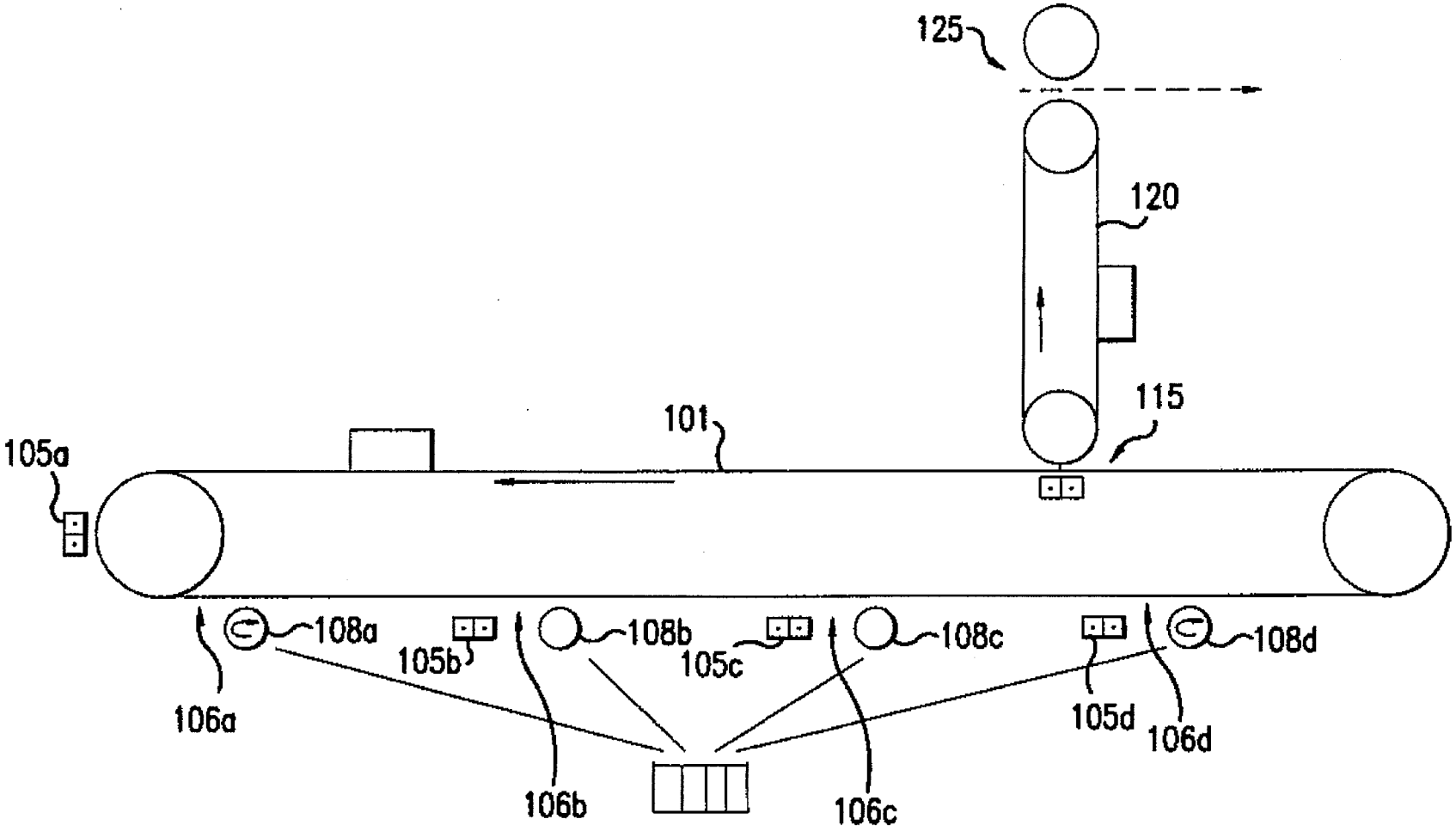
FIG. 3 is a schematic diagram of a single imaging station printing apparatus in which each color of the image is developed on top of preceding developed colors of the image on the imaging member.

FIG. 3 illustrates a printing apparatus using a single imaging station and a single layer intermediate transfer belt in which each color of a multi-color image is sequentially formed and developed in registration on top of previously formed colors of the image on the imaging member. In the figure, a single imaging member 101 is shown as a photoreceptor belt. Other imaging members, such as drums, can also be used. The apparatus also comprises charging structures 105*a*, 105*b*, 105*c* and 105*d*, exposure stations 106*a*, 106*b*, 106*c* and 106*d* and developing stations 108*a*, 108*b*, 108*c* and 108*d*.

A single layer intermediate transfer member 120 is shown in the form of an endless belt and is supported for movement in an endless path. The intermediate transfer member receives the multi-color developed toner image at transfer station 115. The single layer intermediate transfer member carries the image to final transfer station 125 where the image is transferred to an image receiving substrate such as paper or plastic. Again, the use of heat, pressure and/or electrostatic means may be used to assist transfer of the image to the image receiving substrate.

The printing process using the apparatus of FIG. 3 involves first charging the photoreceptor belt with charging structure 105*a*. A first color of a multi-color image to be formed, for example yellow, is then exposed to the photoreceptor belt at exposure station 106*a*. The photoreceptor belt then advances to developing station 108*a* where yellow toner is supplied and a yellow color image is developed.

The photoreceptor belt then advances to charging structure 105*b* where the belt, along with the previously developed color image on the photoreceptor belt, is recharged. Following charging, the photoreceptor belt is exposed to a second color image, for example magenta, of the multi-color image at exposure station 106*b*. The magenta image is then developed at developing station 108*b*. The second developed color image is formed in registration directly upon the previously developed first color image already on the photoreceptor belt.

In like fashion, the cyan and black image components of the multi-color image are developed on top of the previously developed color images. For example, the photoreceptor belt and previous two color images are recharged at charging structure 105*c*, the photoreceptor belt is exposed at exposure station 107*c* to a third color component of the multi-color image such as black, and a third color developed on top of the previously formed color images at developing station 108*c*. Following recharge of the photoreceptor belt at charging structure 105*d*, the final color component of the multi-color image is exposed at exposure station 106*d* and developed on top of the three previously formed color images at developing station 108*d*.

As with the multiple imaging station printing apparatus of FIG. 2, the images are preferably developed using a liquid developer, although dry toners may also be used.

The use of a fluorocarbon elastomer as a single layer intermediate transfer member allows for the production of high quality images that do not suffer from image shifting, color shifting or color degradation. The fluorocarbon elastomers possess superior properties of strength, electrical semiconductivity and conformability to an image receiving substrate that allows for substantially 100% toner transfer to and from the intermediate transfer member, excellent registration of a multi-image or color image, and excellent contact with an image receiving substrate in transferring the image. Further, the single layer advantageously reduces costs as the single layer is less expensive than transfer member layers that include substrates. Costs are also reduced due to ease of manufacturing a single layer in which difficulties in bonding a transfer layer material to a substrate are avoided.

While this invention has been described in conjunction with specific embodiments herein, alternatives, modifications, and variations will be apparent to those skilled in the art. Accordingly, it is intended to embrace all such alternatives, modifications and variations that fall within the spirit and scope of the appended claims.

What is claimed is:

1. An apparatus for forming images, comprising:

at least one imaging station, said at least one imaging station comprising an image receiving member and at least one developing station that produces developed toner images; and an intermediate transfer member for receiving said developed toner images and transferring said developed toner images to an image receiving substrate, wherein said intermediate transfer member comprises a single layer fluorocarbon elastomer without a substrate, said fluorocarbon elastomer comprising a copolymer or terpolymer of two or more materials selected from the group consisting of vinylidene fluoride, hexafluoropropylene, tetrafluoroethylene, chlorotrifluoroethylene and propylene, wherein said single layer intermediate transfer member is conformable to said image receiving substrate.

2. An apparatus according to claim 1, wherein said at least one imaging station is a single imaging station comprising a single image receiving member.

3. An apparatus according to claim 2, wherein said single imaging station further comprises a plurality of developing stations.

4. An apparatus according to claim 1, wherein said apparatus comprises at least two imaging stations, each of said imaging stations comprising an image receiving member and a developing station.

5. An apparatus according to claim 1, wherein said fluorocarbon elastomer comprises an elastomeric copolymer of vinylidene fluoride and hexafluoropropylene.

6. An apparatus according to claim 1, wherein said fluorocarbon elastomer comprises a terpolymer of vinylidene fluoride, hexafluoropropylene and tetrafluoroethylene.

7. An apparatus according to claim 1, wherein said intermediate transfer member has a thickness of from 3 to 15 mils.

8. An apparatus according to claim 1, wherein said intermediate transfer member is seamless.

9. An apparatus according to claim 1, wherein said intermediate transfer member has a resistivity of between $10^7$ to $10^{12}$ ohm-cm, inclusive.

10. An apparatus according to claim 1, wherein said intermediate transfer member has a conductivity of less than or equal to $10^6$ ohm-cm.

11. An apparatus according to claim 1, wherein said intermediate transfer member has a durometer hardness of from 50 to 85 Shore A.

12. An apparatus for forming images, comprising:

at least one imaging station, said at least one imaging station comprising an image receiving member and at least one developing station that produces developed toner images; and an intermediate transfer member for receiving said developed toner images and transferring said developed toner images to an image receiving substrate, wherein said intermediate transfer member comprises a single layer fluorocarbon elastomer without a substrate, said fluorocarbon elastomer comprising a copolymer or terpolymer of two or more materials selected from the group consisting of vinylidene fluoride, hexafluoropropylene, tetrafluoroethylene, chlorotrifluoroetheylene and propylene, wherein said single layer intermediate transfer member contains at least two zones of different electrical properties, and wherein said single layer intermediate transfer member is conformable to said image receiving substrate.

13. An apparatus according to claim 12, wherein each of said at least two zones contains different electrical property regulating fillers.

14. An apparatus according to claim 12, wherein each of said at least two zones contains a different amount of electrical property regulating fillers.

15. A method for producing an image in an apparatus, comprising:

(1) exposing and developing at least one image on at least one image receiving member, (2) transferring said at least one image to an intermediate transfer member, wherein said intermediate transfer member comprises a single layer fluorocarbon elastomer without a substrate, said fluorocarbon elastomer comprising a copolymer or terpolymer of two or more materials selected form the group consisting of vinylidene fluoride, hexafluoropropylene, tetrafluoroethylene, chlorotrifluoroethylene and propylene, wherein said single layer intermediate transfer member is comformable to said image receiving substrate, and (3) transferring said at least one image to an image receiving substrate, wherein said method results in substantially 100% toner transfer.

16. A method according to claim 15, wherein step (1) comprises exposing and developing an image on each of at least two image receiving members, and step (2) comprises sequentially transferring each of said images to said intermediate transfer member in registration.

17. A method according to claim 15, wherein step (1) comprises exposing and developing a first color image on a single image receiving member, exposing and developing at least one additional color image in registration with and on top of said first color image to produce a multiple color image, and step (2) comprises transferring said multiple color image to said intermediate transfer member.

18. A method according to claim 15, wherein said fluorocarbon elastomer comprises an elastomeric copolymer of vinylidene fluoride and hexafluoropropylene.

19. A method according to claim 15, wherein said fluorocarbon elastomer comprises a terpolymer of vinylidene fluoride, hexafluoropropylene and tetrafluoroethylene.

20. A method according to claim 15, wherein said intermediate transfer member has a thickness of from 3 to 15 mils.

21. An intermediate transfer member for transferring a multi-image or multi-color image from one or a plurality of imaging members to an image receiving substrate, comprising a single layer fluorocarbon elastomer without a substrate, said fluorocarbon elastomer comprising a copolymer or terpolymer of two or more materials selected from the group consisting of vinylidene fluoride, hexafluoropropylene, tetrafluoroethylene, chlorotrifluoroethylene and propylene, wherein said single layer intermediate transfer member is conformable to an image receiving substrate.

22. An intermediate transfer member according to claim 21, wherein said fluorocarbon elastomer comprises an elastomeric copolymer of vinylidene fluoride and hexafluoropropylene.

23. An intermediate transfer member according to claim 21, wherein said fluorocarbon elastomer comprises a terpolymer of vinylidene fluoride, hexafluoropropylene and tetrafluoroethylene.

24. An intermediate transfer member according to claim 21, wherein said intermediate transfer member has a thickness ranging from 3 to 15 mils.

25. An intermediate transfer member according to claim 21, wherein said intermediate transfer member is seamless.

26. A method for producing an image in an apparatus, comprising:

(1) exposing and developing at least one image on at least one image receiving member, (2) transferring said at least one image to an intermediate transfer member, wherein said intermediate transfer member comprises a single layer fluorocarbon elastomer without a substrate, said fluorocarbon elastomer comprising a copolymer or terpolymer of two or more materials selected from the group consisting of vinylidene fluoride, hexafluoropropylene, tetrafluoroethylene, chlorotrifluoroethylene and propylene, wherein said single layer intermediate transfer member is conformable to said image receiving substrate, and wherein said single layer intermediate transfer member comprises at least two zones, each of said zones comprising electrical properties that are different from the other, and (3) transferring said at least one image to an image receiving substrate, wherein said method results in substantially 100% toner transfer.

27. An intermediate transfer member for transferring a multi-image or multi-color image from one or more imaging members to an image receiving substrate, comprising a single layer fluorocarbon elastomer without a substrate, said fluorocarbon elastomer comprising a copolymer or terpolymer of two or more materials selected from the group consisting of vinylidene fluoride, hexafluoropropylene, tetrafluoroethylene, chlorotrifluoroethylene and propylene, wherein said single layer intermediate transfer member is conformable to an image receiving substrate, and wherein said single layer intermediate transfer member comprises at least two zones, each of said zones comprising electrical properties that are different from the other.

28. An intermediate transfer member according to claim 27, wherein each of said at least two zones contains different electrical property regulating fillers.

29. An intermediate transfer member according to claim 27, wherein each of said at least two zones contains a different amount of electrical property regulating fillers.

* * * * *

UNITED STATES PATENT AND TRADEMARK OFFICE

CERTIFICATE OF CORRECTION

PATENT NO. : 5,585,903

DATED : December 17, 1996

INVENTOR(S) : Joseph MAMMINO et al.

It is certified that error appears in the above-indentified patent and that said Letters Patent is hereby corrected as shown below:

On the cover page,
In item [21] change "558,538 to --316,344--.
In item [22] change "October 7, 1994" to --September 30, 1994--.

Signed and Sealed this

Twentieth Day of May, 1997

*Attest:*

*Attesting Officer*

BRUCE LEHMAN

*Commissioner of Patents and Trademarks*